United States Patent [19]

Ikeda et al.

[11] Patent Number: 4,572,451

[45] Date of Patent: Feb. 25, 1986

[54] METHOD AND DEVICE FOR WINDING PAPER

[75] Inventors: Noriaki Ikeda, Tokyo; Mutsunori Kai, Noda; Hiraki Asai, Tokyo, all of Japan

[73] Assignee: Ishikawajima-Harima Jukogyo Kabushiki Kaisha, Japan

[21] Appl. No.: 664,013

[22] Filed: Oct. 23, 1984

[30] Foreign Application Priority Data

Dec. 27, 1982 [JP] Japan ..... 57-234801

[51] Int. Cl.[4] ..... B65H 19/20; B65H 19/08

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 2,989,262 | 6/1961 | Hornbostel | 242/56 R |
| 3,687,388 | 8/1972 | Pfeiffer | 242/66 X |
| 3,858,820 | 1/1975 | Crouse | 242/66 |
| 3,869,095 | 3/1975 | Diltz | 242/56 R |
| 4,133,495 | 1/1979 | Dowd | 242/66 |
| 4,327,877 | 5/1982 | Perini | 242/66 |

FOREIGN PATENT DOCUMENTS

| | | |
|---|---|---|
| 26148 | 3/1980 | Japan . |
| 51549 | 3/1982 | Japan . |

*Primary Examiner*—Stuart S. Levy
*Assistant Examiner*—Lloyd D. Doigan

[57] ABSTRACT

When the winding operation is started, the leading edge portion of the sheet is sucked and held by one of a pair of horizontally disposed rollers and the extension of the leading edge portion of the sheet beyond the one roller is controlled by rotation of said one roller. An adhesive with a suitable viscosity is sprayed against a core from the position below the core. The core and said one roller are rotated so that the sheet is clamped between the one roller and the portion of the core which is applied with the adhesive and consequently is bonded to the core. Thereafter the pair of rollers are rotated at a low speed so that the slack of the sheet is eliminated. Next the sheet is wound around the core at a high speed. After the winding operation, an adhesive with a suitable viscosity is sprayed against a roll of paper from below so that the sheet is bonded by the weight of the roll of paper itself. Thereafter the sheet is cut off and the roll of paper is pushed out.

2 Claims, 17 Drawing Figures

METHOD AND DEVICE FOR WINDING PAPER

BACKGROUND OF THE INVENTION

The present invention generally relates to paper winding and more particularly relates to a method and device for winding a sheet of paper around a core in a simple manner when the sheet is unwound from an unwinding device.

FIGS. 1*a*, 1*b* and 1*c* show a conventional paper winding method in a paper machine. A core 3 is disposed between rotary rollers 1 and 2 and is rotated in unison therewith. The leading edge of a sheet of paper 4 unwound from an unwinding device (not shown) and transported is made to pass through the gap between the rollers 1 and 2 and is wound around the core 3.

As described above, when the sheet 4 is wound around the core 3, it must be passed between the rollers 1 and 2. This operation is very difficult because the gap between and space underneath the rollers 1 and 2 is very narrow. Furthermore, the leading edge of the sheet 4 is bonded by means of an adhesive tape whose both surfaces are coated with an adhesive agent, this work is also difficult and not efficient.

After a predetermined length of the sheet 4 has been wound around the core 3, the paper roll 5 is removed and a new core 3 is disposed again between the rollers 1 and 2. In this case, an operator cuts off the sheet 4 and the trailing edge of the sheet 4 is bonded to the paper roll 5 with an adhesive tape whose both surfaces are coated with an adhesive agent.

Thus, the sheet winding operation must be started and finished manually so that the winding operation is not efficient and the rate of operation is remarkably low.

In view of the above, the primary object of the present invention is to completely automate the paper winding operation so that efficiency and the rate of operation can be remarkably improved.

BRIEF DESCRIPTION OF THE DRAWINGS

The same reference numerals are used to designate similar parts throughout the figures.

DESCRIPTION OF THE PREFERRED EMBODIMENT

Figure 1A:
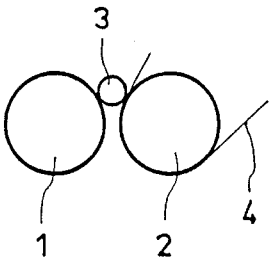
FIGS. 1*a*, 1*b* and 1*c* are views used to explain a conventional method for winding a sheet of paper around a core.
Figure 1B:
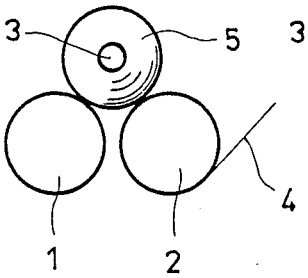
PRIOR ART Fig.1b
Figure 1C:
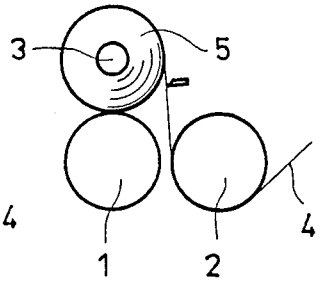
PRIOR ART Fig.1c
Figure 2:
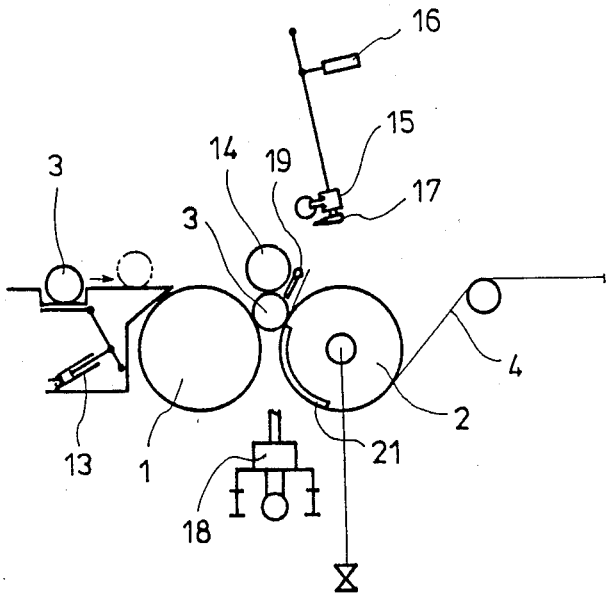
PRIOR ART Fig.2
FIG. 2 is a schematic view of an embodiment of a device for winding a sheet of paper in accordance with the present invention.
Figure 3:
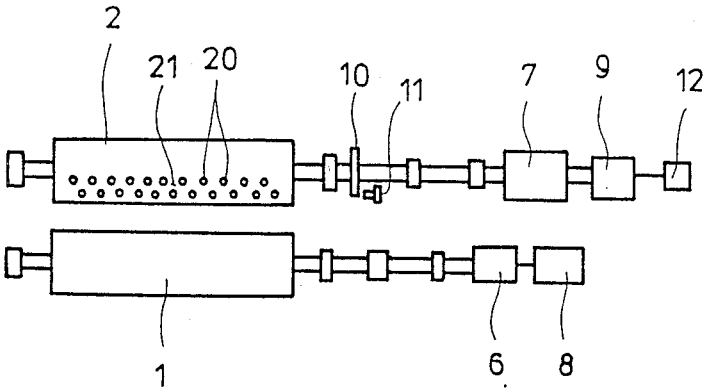
FIG. 3 is a partial top view thereof.
Figure 4:
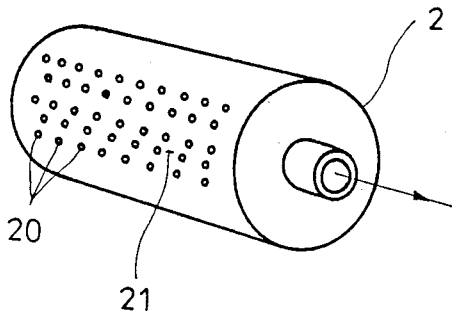
FIG. 4 is a perspective view of a rear roller.

Referring first to FIGS. 2, 3 and 4, a front roller 1 and a rear roller 2 are disposed horizontally and coupled to DC motors 6 and 7 and electromagnetic brakes 8 and 9, respectively. The rear roller 2 has a notched disk 10 and a proximity sensor 11 and the DC motor 7 is connected to a pulse generator 12. A core supplying device 13 is disposed in order to supply a core 3 between the rollers 1 and 2 and a sheet of paper 4 unwound from a unwinding device (not shown) is wound around the core 3. The core 3 is pressed by a rider roller 14 and is rotated in unison with the rollers 1 and 2. The rider roller 14 is disposed above the rollers 1 and 2 and is vertically movable so that it can exert a predetermined magnitude of force to the core 3 disposed between the rollers 1 and 2. An ejector 15 removes a paper roll 5 from the rollers 1 and 2 after a predetermined length of the sheet 4 has been wound around the core 3. The ejector 15 swings like a pendulum by means of a cylinder 16 and a cutter 17 for cutting off the sheet 4 extended between the rear roller 2 and the wound paper roll 5 is attatched to the lower end of the ejector 15.

An adhesive spraying device 18 for spraying an adhesive to the core 3 and the wound paper roll 5 through the gap between the rollers 1 and 2 is disposed so as to be movable in the crosswise direction of the sheet 4. Disposed below the rider roller 14 and adjacent to the rear roll 2 is an air injection nozzle 19 for pressing the leading edge of the sheet 4 against the core 3 so that the leading edge of the sheet 4 may be prevented from being folded when it is inserted between the core 3 and the rider roller 14.

As shown in FIG. 4, the rear roller 2 comprises a hollow cylinder and a plurality of suction ports 20 are drilled in the cylindrical shell of the rear roller and are connected with the bore of the rear roller 2 which in turn is connected with a suction device (not shown) so that the air is sucked from the bore of the rear roller 2 and consequently the leading edge of the sheet 4 is pressed against a suction portion 21 comprising the suction ports 20. The notched disk 10 and the sensor 11 are used to detect the position of the suction portion 21. In responce the the output signal from the sensor 11, the electromagnetic brake 9 is actuated so that the suction portion 21 is brought to a predetermined position. The pulse generator 12 is used to detect the rotational speed and the direction of rotation of the rear roller 2.

Referring to FIGS. 5*a*–5*h*, the mode of operation will be described. The leading edge 4' of the sheet 4 is held at the suction portion 21 and is extended upwardly by a predetermined length. The core supplying device 13 supplies a core 3 (See FIG. 5*a*). The rear roller 2 is reversed in rotation (in the counterclockwise direction) so that the extended leading edge 4' of the sheet 4 is shortened. And then the brake 9 is actuated so as to stop the rear roller 2 (See FIG. 5*b*). The rider roller 14 is lowered and the adhesive spraying device 18 is actuated and moved in the crosswise direction of the sheet 4 so that an adhesive which is heated to have a suitable degree of viscosity is sprayed against the core 3 in full width of core (See FIG. 5*c*). Air is discharged through the air injection nozzle 19 (See FIG. 2) and in response to the output signal from the pulse generation 12, the rollers 1 and 2 are rotated at a low speed to advance the sheet 4 and to rotate the core 3 until the adhesive applied portion of the core 3 is registered with the suction portion 21 of the rear roller 2. Then, the rear roller 2 is stopped so that the leading edge portion of the sheet 4 is held between the adhesive applied portion of the core 3 and the suction portion 21 of the rear roller 2 for a predetermined time (See FIG. 5*d*). In this case, the angle of rotation of the rear roller 2 is controlled in response to the number of pulses transmitted from the pulse generator 12. After the predetermined time, the rollers 1 and 2 are rotated at a low speed so that the leading edge portion of the sheet 4 is wrapped around the core 3. In this case, the rollers 1 and 2 are rotated such that the slack of the sheet 4 which is caused when the rollers 1 and 2 are rotated in the counterclockwise direction may be eliminated. In the step during which the leading edge portion of the sheet 4 is wrapped around the core, the air is blown from the air injection nozzle 19 against the core 3 so that the leading edge portion of the sheet 4 is prevented from being folded when the leading edge of the sheet 4 passes between the core 3 and the rider roller 14 (See FIG. 5*d*). After the leading edge portion of the sheet 4 has been wrapped around the core 3, the air injection nozzle 19 stops blowing air. The rotational speed of the rollers 1 and 2 is increased so that the sheet 4 is wound around the core 3 at a high speed. When a wound length of the sheet 4 is approaching to predetermined value, the rollers 1 and 2 decelerate and finally stop in response to the output signal from the proximity sensor 11. In this case, the suction portion 21 of the rear roller 2 faces with the front roller 1 (See FIG. 5*e*).

Figure 5A:
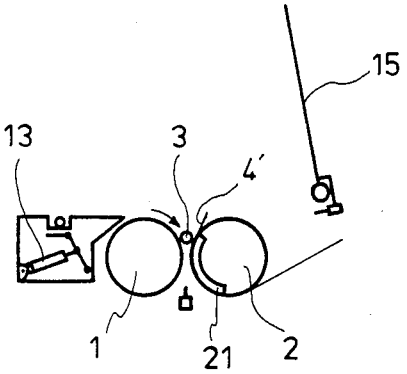
FIGS. 5*a*–5*h* are views used to explain the mode of operation of the device for winding a sheet of paper.
Figure 5B:
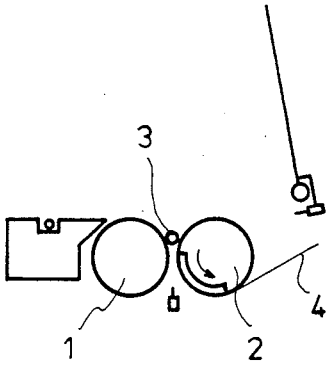
Figure 5C:
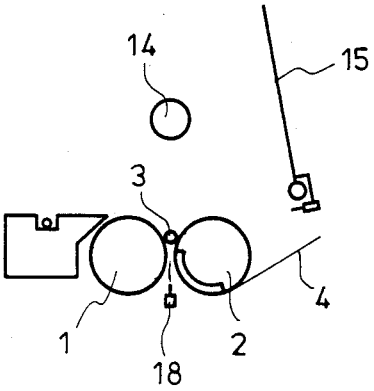
Figure 5D:
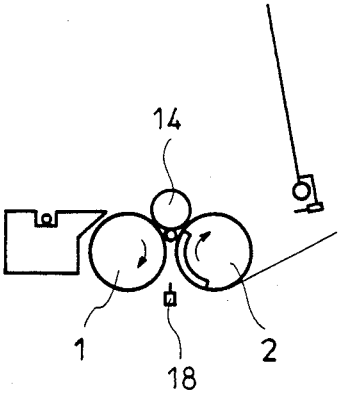
Figure 5E:
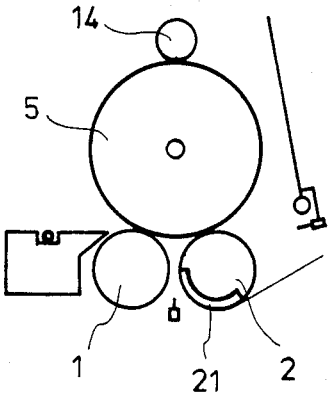
Figure 5F:
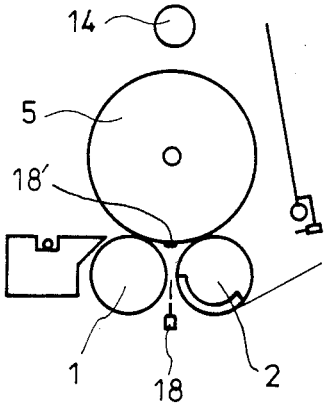
Figure 5G:
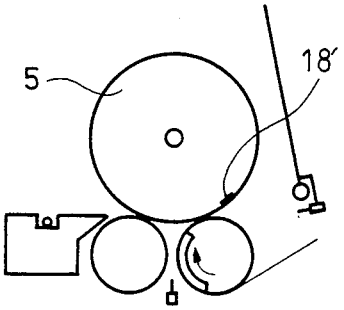

The adhesive spraying device 18 sprays the adhesive (See FIG. 5*f*). Thereafter the rollers 1 and 2 are rotated at a low speed through a predetermined angle so that the adhesive-sprayed area 18' on the sheet 4 is pressed against the next wound layer of sheet (See FIG. 5*g*). The ejector 15 is actuated to push the roll 5. Before the pushed roll 5 passes over the front roller 1, the ejector 15 is once stopped and the cutter cuts off the sheet 4. Therefore the leading edge portion 4' of the sheet 4 is extended upwardly by a predetermined length as described before with reference to FIG. 5*a* and is sucked by the rear roller 2. The ejector 15 is further driven so that the paper roll 5 is pushed out of the winding device (See FIG. 5*h*).

The above-described steps are repeated so that the sheet winding operation can be carried out automatically.

The effects, features and advantages of the present invention may be summarized as follows:

(i) The manual operation for bonding the leading edge of the sheet to the core and bonding the trailing edge of the sheet to the paper roll can be eliminated. That is, the manual operation in the winding device can be eliminated so that the winding operation can be carried out safely.

(ii) The winding operation can be fully automated so that the operating efficiency can be considerably improved.

(iii) Labors can be saved and the duty cycle of the winding operation can be improved.

Figure 5H:
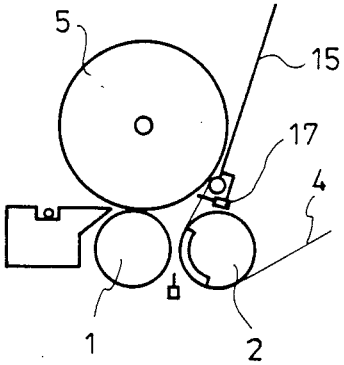
Figure 6:
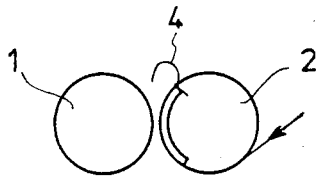
FIG. 6 is a view used to explain a phenomenon which may occur at leading edge of paper when sheet of paper is thin.
Figure 7:
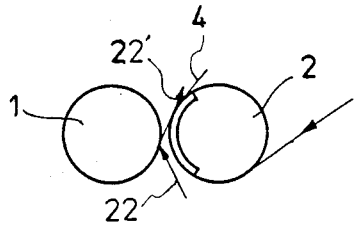
FIG. 7 is a view used to explain how to overcome the phenomenon mentioned above.

In the case of a sheet of paper having no rigidity, when the sheet 4 is cut off by the cutter 17 as shown in FIG. 5*h*, the leading edge portion of the sheet 4 may be bent as shown in FIG. 6. In order to prevent such bending of the sheet 4, air 22 is blown against the front roller 1. Air 22' reflected from the front roller 1 presses the bent leading edge portion of the sheet 4 against the rear roller 2 (See FIG. 7).

Figure 8:
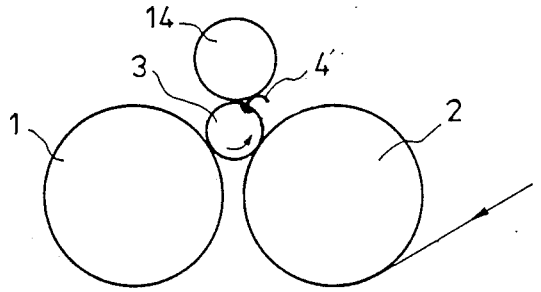
FIG. 8 is a view used to explain a phenomenon which may occur when a leading edge of paper is inserted between the core and a rider roller.

When a sheet of paper has no rigidity, the leading edge portion 4' of the sheet 4 wrapped around the core 3 may be bent in the reverse direction as shown in FIG. 8. In order to overcome this problem, after the leading edge portion 4' of the sheet 4 has passed past the suction portion 21 of the rear roller, the air is blown from the suction portion 21 so that the leading edge of the sheet 4 is pressed against the core 3.

What is claimed is:

1. In a method for winding a sheet of paper in which a core is supplied between a pair of horizontally disposed rollers and is pressed against said pair of rollers by a rider roller and the sheet of paper is wrapped around one of said pair of rollers so as to wind said sheet of paper around said core, the improvement comprising sucking and holding a leading edge portion of said sheet of paper by said one roller when the winding operaton is started, shortening the extended leading edge portion of said sheet of paper by reverse rotation of said one roller, spraying an adhesive with a suitable viscosity against said core from a position below said core, rotating said core and said pair of rollers so that said leading edge portion of said sheet of paper is clamped between a portion of said core which is applied with said adhesive and said one roller and is bonded to said core, rotating said pair of rollers at a low speed so that any slack of said sheet of paper whose leading edge portion is bonded to said core is eliminated, thereafter rotating said pair of rollers at a high speed to wind said sheet of paper around said core, and after completion of the winding of said sheet of paper into a roll of paper, spraying an adhesive with a suitable viscosity against the roll of paper from below so that said sheet of paper is bonded by a weight of the roll of paper itself, thereafter cutting off said sheet of paper and pushing out said roll of wound paper.

2. A device for winding a sheet of paper comprising a pair of rotatable and horizontally disposed rollers, one of said pair of rollers having a suction portion for sucking and holding the sheet of paper, said one roller further having a sensor for detecting an angular position of said one roll and a pulse generator so that a direction of rotation, a rotational speed and a position at which said one roller is stopped can be controlled, core supply means adjacent to the other of said pair of rollers, a rider roller above said pair of rollers for pressing said core against said pair of rollers, an ejector for pushing out a roll of wound paper and cutting said sheet of paper, and adhesive spraying means below said pair of rollers for spraying an adhesive with a suitable viscosity through a gap between said pair of rollers.

* * * * *